US012366187B2

(12) United States Patent
Hauptvogel et al.

(10) Patent No.: US 12,366,187 B2
(45) Date of Patent: Jul. 22, 2025

(54) METHOD FOR DIAGNOSING A CRANKCASE SYSTEM OF AN INTERNAL COMBUSTION ENGINE, AND INTERNAL COMBUSTION ENGINE

(71) Applicant: Volkswagen Aktiengesellschaft, Wolfsburg (DE)

(72) Inventors: Mathias Hauptvogel, Weferlingen (DE); Stephan Wassmann, Isenbuettel (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 18/642,590

(22) Filed: Apr. 22, 2024

(65) Prior Publication Data

US 2024/0352878 A1 Oct. 24, 2024

(30) Foreign Application Priority Data

Apr. 20, 2023 (DE) ..... 10 2023 110 091.2

(51) Int. Cl.
*F01M 11/10* (2006.01)
*F01M 13/00* (2006.01)
*F01M 13/02* (2006.01)

(52) U.S. Cl.
CPC ..... *F01M 11/10* (2013.01); *F01M 13/02* (2013.01); *F01M 2013/0083* (2013.01); *F01M 2013/027* (2013.01)

(58) Field of Classification Search
CPC ..... F01M 13/02; F01M 2013/027; F01M 2013/0083
See application file for complete search history.

(56) References Cited

U.S. PATENT DOCUMENTS

| | | | | |
|---|---|---|---|---|
| 9,068,486 | B2 | 6/2015 | Rollinger et al. | |
| 9,127,578 | B2 | 9/2015 | Pursifull et al. | |
| 9,664,079 | B2 | 5/2017 | Jentz et al. | |
| 10,907,591 | B2 | 2/2021 | Golladay et al. | |
| 2014/0081549 | A1 | 3/2014 | Rollinger et al. | |
| 2021/0348529 | A1 * | 11/2021 | Gruenbeck | F01M 13/04 |
| 2021/0348532 | A1 | 11/2021 | Holzeder et al. | |

FOREIGN PATENT DOCUMENTS

| | | | | |
|---|---|---|---|---|
| DE | 102013218296 | A1 | 5/2014 | |
| DE | 102015116483 | A1 | 4/2016 | |
| DE | 102015213982 | A1 | 1/2017 | |
| DE | 102017203201 | A | 8/2018 | |
| DE | 102019200982 | A1 | 7/2020 | |
| DE | 102019200978 | B4 | 11/2020 | |
| DE | 102023110091 | B3 * | 8/2024 | F01M 11/10 |

* cited by examiner

*Primary Examiner* — Ngoc T Nguyen
(74) *Attorney, Agent, or Firm* — Muncy, Geissler, Olds & Lowe, P.C.

(57) ABSTRACT

A method for diagnosing a crankcase system of an internal combustion engine. A pressure value is captured in a crankcase system. A pressure value of a reference pressure is ascertained or a pressure value to be expected in the crankcase system is modeled. A gradient of the pressure value in the crankcase system and a gradient of the reference pressure or the modeled pressure in the crankcase system is formed. The two formed gradients are integrated over time. The function of the crankcase system is evaluated based on the values obtained by the integrations. A control device as well as an internal combustion engine for carrying out the method are provided.

15 Claims, 5 Drawing Sheets

METHOD FOR DIAGNOSING A CRANKCASE SYSTEM OF AN INTERNAL COMBUSTION ENGINE, AND INTERNAL COMBUSTION ENGINE

This nonprovisional application claims priority under 35 U.S.C. § 119 (a) to German Patent Application No. 10 2023 110 091.2, which was filed in Germany on Apr. 20, 2023, and which is herein incorporated by reference.

BACKGROUND OF THE INVENTION

Field of the Invention

The invention relates to a method for diagnosing a crankcase system of an internal combustion engine as well as an internal combustion engine including a crankcase system of this type according to the definition of the species in the independent patent claims.

Description of the Background Art

Internal combustion engines include crankcases, in which a crankshaft of the internal combustion engine is arranged. An oil sump for lubricating movable components of the internal combustion engine is also provided in the crankcase. Oil vapors may be present in the crankcase due to evaporating oil. In addition, a small amount of gas from the combustion chamber always gets inside the crankcase, since the piston rings do not seal the gap between a piston of the internal combustion engine and the cylinder completely gas-tight. To avoid an overpressure in the crankcase, these gases and vapors must be discharged from the crankcase. The discharge of the gases and vapors generally takes place into an air supply system of the internal combustion engine, and thus into the combustion chamber, to avoid uncontrolled environmental emissions by these gases and vapors.

The increasing requirements in the exhaust gas legislation make it necessary that a breather of the crankcase not only functions continuously, but also that the function of the crankcase breather also may be monitored as part of an on-board diagnosis. One possibility for monitoring the function of the crankcase breather, in particular to identify breaches in the lines of the crankcase breather, is to capture a pressure in the crankcase. Possible damage to the crankcase breather are, for example, damaged or kinked fresh air hoses, non-plugged-in or damaged lines which transport the crankcase gases, detached closure caps in the crankcase which block or release a ventilation or breather opening, a defective seal, or the like. A malfunctioning crankcase breather may also result in an increased wear or damage to engine components over the long term.

Different approaches may be used to monitor the integrity of a crankcase ventilation system. For example, diagnostic blow-by approaches may be used, in which a pressure sensor used in the crankcase and a valve in a PCV fresh air hose are opened, and a breach in the system is determined based on resulting changes in the crankcase pressure or vacuum. Another example of an approach, which is known from US 2014/0081549 A1, is based on a pressure sensor of the crankcase ventilation hose to detect a separation of the ventilation tube/hose. Still other approaches may use a combination of pressure sensors, which are positioned at different points in the crankcase ventilation system to monitor the integrity of the crankcase ventilation system.

An internal combustion engine including a crankcase breather is known from DE 10 2015 116 483 A1, which corresponds to US 2016/0097355. A crankcase sensor is provided to diagnose a position and type of an integrity breach of a crankcase ventilation system. Readings of the integrated CVT pressure are used to diagnose a separation of the CVT on the air inlet side and to distinguish it from a separation on the crankcase side.

SUMMARY OF THE INVENTION

It is therefore an object of the invention to further improve a diagnosis of the crankcase breather and to dependably detect damage to the ventilation and breather system of the crankcase.

According to the invention, this object is achieved by a method for diagnosing a crankcase system of an internal combustion engine, which comprises the following steps: capturing a pressure value in a crankcase system; ascertaining a pressure value of a reference pressure or modeling a pressure value to be expected in the crankcase system; forming a gradient of the pressure value in the crankcase system and a gradient of the reference pressure or of the modeled pressure in the crankcase system; integrating the two formed gradients over time; and evaluating the function of the crankcase system based on the values obtained by the integrations.

A gradient in this connection can be understood to be not only a gradient in the narrow mathematical sense, but also a differentiator of the xth order, since the method takes place in discrete temporal steps and not in infinitesimally small steps. An integration in this connection is understood to be not only an integration in the narrow mathematical sense, but also a temporal summation of values in discrete time intervals. A crankcase system in this connection is understood to be a system which comprises at least the crankcase, a ventilation line, and a breather line. The crankcase system may additionally comprise further ventilation or breather lines as well as an oil separator, one or multiple throttle(s), one or multiple check valve(s), one or multiple pressure control valve(s), and/or a Venturi nozzle, in particular a suction jet pump. At least one pressure sensor is furthermore assigned to the crankcase system, which captures a pressure in the crankcase system.

The described method permits an exact and reliable diagnosis of the function of the crankcase system of an internal combustion engine, in particular the ventilation and breathing of the crankcase. Since the change in the pressure in the crankcase is dependent on the change in the reference pressure, a function of the crankcase breather may be inferred from the relation of the pressure change of the pressure in the crankcase and the pressure change of the reference pressure. If the crankcase breather is defective, the pressure change in the crankcase does not follow the pressure change of the reference value, so that a malfunction or a defect of the crankcase breather may be inferred. The method not only permits the detection of a defective or fallen-off hose of the crankcase system but also the detection of a blockage of a line of this type. A blockage of a hose line of the crankcase system results in an increase of the pressure in the crankcase system and thus in positive pressure gradients. These may be evaluated using the same diagnostic method.

Alternatively, the pressure change in the crankcase may be related to a pressure change to be expected in the crankcase, a malfunction or a defect of the crankcase breather being able to be inferred from a deviation of the actual change of the pressure in the crankcase from a change of the pressure in the crankcase stored in a model during a certain operation of the internal combustion engine.

The internal combustion engine can be designed as an internal combustion engine supercharged with the aid of an exhaust gas turbocharger, the reference pressure in an intake manifold or in one of the lines associated therewith of an air supply system of the internal combustion engine being captured, the intake manifold connecting a compressor of the exhaust gas turbocharger with an inlet of the internal combustion engine. The pressure in the intake manifold changes, in particular, during an acceleration process and a boost pressure buildup of the exhaust gas turbocharger associated therewith. A pressure change to be expected in the crankcase system may be derived from the change, in particular, from the pressure rise in the intake manifold. If the ascertained pressure change in the crankcase system deviates from the change of the pressure to be expected in the crankcase system, the function of the crankcase breather may be inferred from the amount of the deviation.

The change of the reference pressure in the intake manifold can be captured downstream from a throttle valve. A capture of the pressure in the intake manifold downstream from the throttle valve is particularly favorable, since secondary effects during the boost pressure buildup may be disregarded. As a rule, the pressure in the intake manifold essentially corresponds to the boost pressure of the exhaust gas turbocharger when the throttle valve is opened all the way.

It is also advantageously provided that the change of the reference pressure in the intake manifold can be captured downstream from the compressor and upstream from a throttle valve, i.e., as the boost pressure of the exhaust gas turbocharger.

A breathing of the crankcase can take place in an intake line of an air supply system in a first operating point or in a first operating range of the internal combustion engine and in an intake manifold of an air supply system in a second operating point or in a second operating range. To breathe the crankcase, a pressure gradient is always needed to ensure a flow of the gas out of the crankcase into the air supply system of the internal combustion engine. Since this pressure gradient is not present in each operating point to ensure a breathing in all operating points either in the intake line or in the intake manifold, it is useful to select a breathing path as a function of the operating point of the internal combustion engine, in which an adequate pressure gradient is present for breathing the crankcase.

The first operating range can be a high partial load range or a full load range and the second operating range can be an idle or a low partial load range.

A driving flow can be provided by a turbocharger, and a Venturi nozzle, in particular a suction jet pump, is arranged or formed in a breather line of the crankcase, with the aid of which an underpressure is generated or amplified in the crankcase system. In a high partial load range or a full load range, a correspondingly high driving flow may be made available, so that an underpressure is generated by the Venturi nozzle, which sucks the air out of the crankcase and supplies it to the intake line via the Venturi nozzle. A suction jet pump is a particularly efficient embodiment of a Venturi nozzle, which favors the generation of a stable underpressure in the crankcase system.

An initiation of the method can take place when a boost pressure of an exhaust gas turbocharger and/or an intake manifold pressure has exceeded a defined threshold value. The buildup of a boost pressure is particularly suitable as the enabling condition for starting the method, since the boost pressure buildup results in a significant change of the pressure in the intake manifold and thus provides an easy-to-evaluate reference value for the change of the pressure in the crankcase.

An initiation of the method may take place when an underpressure at a Venturi nozzle in a breather line of the crankcase system drops below a defined threshold pressure. An adequate pressure gradient may be detected thereby, which permits a diagnosis of the crankcase system, in particular the ventilation and breathing of the crankcase system.

A change of the pressure in the crankcase can be evaluated as a reaction to a change of the boost pressure during a pressure buildup or a pressure reduction of the boost pressure of an exhaust gas turbocharger. In the case of a boost pressure buildup as well as in the case of a boost pressure reduction, a corresponding pressure change in the intake manifold occurs downstream from the compressor of the exhaust gas turbocharger. This pressure change may be used to evaluate whether a pressure change also occurs in the crankcase system.

The measurement range can last from a start of the change of the boost pressure to a point in time at which no further rise or fall of the boost pressure takes place. An interval may be easily defined thereby, in which a change of the pressure in the crankcase results in a change of the boost pressure and may be correspondingly evaluated by an integration.

The pressure in the crankcase system can be captured in a breather line of the crankcase. An advantage of the arrangement of the pressure sensor in the breather line is that the risk of a freezing of the pressure sensor is reduced, since measuring tip of the pressure sensor sits directly in a mass flow guided through the crankcase and is heated by the waste heat of the internal combustion engine. A condensate formation on the pressure sensor is avoided thereby. The pressure value of the pressure sensor is essentially in reverse proportion to a pressure in the intake manifold or a boost pressure of the internal combustion engine. In addition, if positioned in the breather line, the pressure sensor is seated in the direct vicinity of the defect patterns to be detected, so that a drop in the breathing capacity of the crankcase or a breach of a breather line may be particularly safely detected.

The pressure in the crankcase system can be arranged in a ventilation line. The positioning in a ventilation line also permits a comparatively easy positioning of the pressure sensor. However, the pressure control behavior of the pressure control valve of the crankcase system must also be taken into account, so that the pressure value in the ventilation line does not follow the pressure change quite so directly during the buildup or reduction of the boost pressure.

The pressure in the crankcase may also itself be measured. A positioning of the sensor in the crankcase is structurally more complex and generally associated with added costs. A position of this type, however, also permits a secure and reliable detection of a malfunction or a defect in the crankcase system.

An initiation of the method can take place when the integral of the reference pressure gradient or the integral of the modeled pressure gradient in the crankcase system exceeds a defined threshold value. By setting a threshold value for the pressure gradient, it is possible to ensure that an adequate pressure change of a reference pressure is present to evaluate the reaction of the pressure in the crankcase system. Faulty diagnoses due to an excessively small pressure difference may thus be avoided, whereby the diagnostic accuracy of the method is increased.

The results of the integrations can each be compared with a threshold value, and upon exceeding a first threshold value or upon dropping below a second threshold value for the integral of the pressure on the crankcase system, a defect in the crankcase system is inferred. The evaluation against absolute threshold values is a secure and reliable possibility for evaluating the function of the crankcase system and, in particular, to be able to diagnose a function of the ventilation and breathing of the crankcase system. A rise in the boost pressure or the pressure in the intake manifold in an intact crankcase system results in a drop in the pressure in the crankcase system. If the crankcase system is defective, a rise in the pressure in the intake manifold results in a constant or rising pressure in the crankcase system. The first threshold value and the second threshold value preferably have an identical absolute value but differ from each other in their signs.

A relation of the two integrals or a difference from the two integrals can be formed, and a function of the crankcase breather is inferred based on the relation or the difference. The evaluation of the integrals relative to each other offers a secure and reliable possibility for evaluating the function of the crankcase system and, in particular, to be able to detect a fault or a defect in the ventilation and breathing of the crankcase system.

The pressure signal of the reference pressure or of the modeled pressure in the crankcase system and the pressure signal of the measured pressure in the crankcase system can be filtered. In this connection, in particular, a PTx element of arbitrary order may be provided as the filter, x preferably being in the interval from 1 to 3. Due to a filtering of the pressure signal of the reference pressure and the pressure signal of the pressure in the crankcase system, the evaluation may be made easier and further improved in terms of its accuracy since individual high or low pressure values do not result in a misdiagnosis.

A further aspect of the invention relates to a control device including a memory unit and a computing unit, a computer program code being stored in the memory unit, which, when executed by the computing unit, carries out a method of this type for diagnosing a crankcase breather of an internal combustion engine.

A further partial aspect of the invention relates to an internal combustion engine, including at least one combustion chamber, the combustion chamber being limited by a piston, which is connected to a crankshaft via a connecting rod, the crankshaft being arranged in a crankcase. The internal combustion engine comprises a control device described in the preceding paragraph.

Further, it can be provided that the internal combustion engine is designed as an internal combustion engine supercharged with the aid of an exhaust gas turbocharger.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
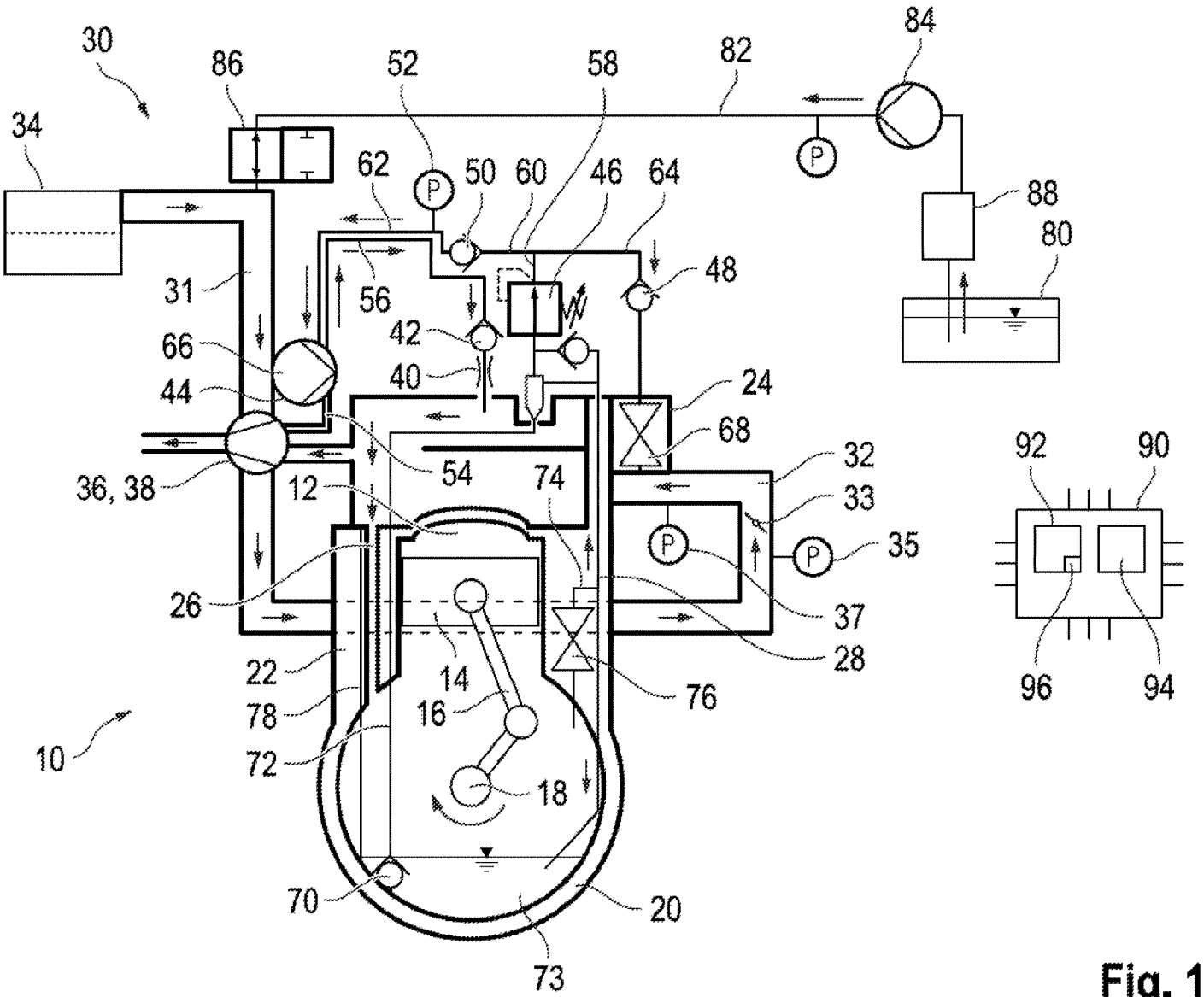
FIG. 1 shows an example of an internal combustion engine for carrying out a method according to the invention to diagnose a crankcase system of the internal combustion engine.

FIG. 1 shows an example of an internal combustion engine 10 for carrying out a method according to the invention to diagnose a crankcase system 20, 26, 28, 56, 58, in particular, to diagnose the ventilation and breathing of crankcase system 20, 26, 28, 56, 58 of internal combustion engine 10. Internal combustion engine 10 includes an engine block 22 and a cylinder head 24. Internal combustion engine 10 furthermore includes at least one combustion chamber 12, which is limited by cylinder head 24, engine block 22, as well as a piston 14. Internal combustion engine 10 preferably includes multiple combustion chambers 12. Piston 14 is connected via a connecting rod 16 to a crankshaft 18, which converts an oscillating movement of piston 14 into a rotational movement. Crankshaft 18 is surrounded by a crankcase 20, which is connected to engine block 22 of internal combustion engine 10.

Internal combustion engine 10 is connected to an air supply system 30 on the inlet side, via which fresh air may be supplied to combustion chamber 12 of internal combustion engine 10. Air supply system 30 comprises an air filter 34 for filtering the sucked-in air. Air supply system 30 further comprises an intake line 31, which connects air filter 34 to a compressor 36 of an exhaust gas turbocharger 38. Compressor 36 of exhaust gas turbocharger 38 is connected to an inlet of internal combustion engine 10 via an intake manifold 32. A throttle valve 33 is arranged in intake manifold 32 for controlling the amount of air supplied to combustion chamber 12. A boost pressure sensor 35 for capturing a boost pressure of exhaust gas turbocharger 38 is arranged in intake manifold 32 downstream from compressor 36 of exhaust gas turbocharger 38 and upstream from throttle valve 33. An intake manifold pressure sensor 37 is arranged in the intake manifold downstream from the throttle valve and upstream from the inlet of internal combustion engine 10. The intake manifold pressure essentially corresponds to the boost pressure of exhaust gas turbocharger 38 when throttle valve 33 is opened all the way.

Internal combustion engine 10 is furthermore connected to an exhaust system via its outlet, a turbine 39 of exhaust gas turbocharger 38 being arranged in the exhaust system, through which an exhaust gas flow of internal combustion engine 10 flows and drives compressor 36 of exhaust gas turbocharger 38.

A ventilation channel 26 is formed in engine block 22, which establishes a fluid connection between a first region of cylinder head 24 and crankcase 20. A breather channel 28 is also formed in engine block 22, which fluidically connects crankcase 20 to a second region of cylinder head 24. An oil recirculation channel 70 is provided in crankcase 20, via which oil may flow back into an oil pan 73. A first oil separator 72 is furthermore arranged in crankcase 20, to prevent oil mist from entering ventilation channel 26. A second oil separator 74 is additionally arranged in crankcase 20, which prevents an entry of oil mist into breather channel 28. In addition, an oil recirculation channel 78 is formed in engine block 22 to permit a back-flow of oil into oil pan 73.

A first flow path is provided for breathing crankcase 20, via which fresh air compressed by compressor 36 of exhaust gas turbocharger 38 may be introduced into crankcase 20 via a purge line 54, a ventilation line 56 in cylinder head 24, and ventilation channel 26. A check valve 42 is arranged in ventilation line 56 to avoid an uncontrolled outflow of air from crankcase 20. A throttle 40 may also be arranged in ventilation line 56 to limit the amount of fresh air supplied to crankcase 20.

To discharge the air from crankcase 20, a second flow path is provided, via which the air may be supplied from crankcase 20 to air supply system 30 via breather channel 28 and a breather line 58 in cylinder head 24 of internal combustion engine 10. A pressure control valve 46 is arranged in breather line 58. Breather line 58 has a branch 60 downstream from pressure control valve 46, at which breather line 58 is divided into a first section 62, which is connected to intake line 31 of the internal combustion engine via a suction jet pump 44, and into a second section 64, which is connected to intake manifold 32 of air supply system 30. A check valve 50 is arranged in first section 62, which prevents an inflow of fresh air from intake line 31 into breather line 58. First section 62 opens into intake line 31 of air supply system 30 at an opening 66, which is situated downstream from air filter 34 and upstream from compressor 36 of exhaust gas turbocharger 38. A check valve 48 is arranged in second section 64, which prevents an inflow of fresh air from intake manifold 32 into breather line 58. Second section 64 opens into intake manifold 32 of air supply system 30 at a second opening 68 downstream from throttle valve 33. A fallen-off or defective breather line 58 results in the fact that no or only a small amount of gases may be transported from crankcase 20 into intake line 31 in the direction of opening 66. As a result, in the event of a boost pressure buildup of exhaust gas turbocharger 38, no or only a less-than-expected amount of fresh air would also flow into crankcase 20 via ventilation line 56 and ventilation channel 26. The evaluation of a volume flow through ventilation line 56 may thus be used to diagnose the function of the crankcase breather. In addition, a lower-than-expected underpressure would set in downstream from throttle 40 in ventilation line 56, so that the pressure measured at sensor 52 or a pressure change resulting from a pressure change in intake manifold 32 as a result of a boost pressure buildup may also be used to diagnose the function of the crankcase breather.

Crankcase system 20, 26, 28, 56, 58 comprises at least crankcase 20, a ventilation line 26, 56, and a breather line 28, 58. Crankcase system 20, 26, 28, 56, 58 may additional comprise further ventilation or breather lines 60, 62 as well as an oil separator 72, 74, a throttle 40, a check valve 42, 48, 50, a pressure control valve 46, and/or a Venturi nozzle 44, in particular a suction jet pump. At least one pressure sensor 52 is furthermore assigned to crankcase system 20, 26, 28, 56, 58, which captures a pressure in crankcase system 20, 26, 28, 56, 58.

Internal combustion engine 10 is furthermore operatively connected to a fuel supply system. To avoid an uncontrolled escape of fuel vapors from fuel tank 80, an active carbon filter 88 is provided, in which these fuel vapors are trapped and bound. Active carbon filter 88 is connected to intake line 31 of air supply system 30 via a tank venting line 82. To regenerate active carbon filter 88, a purge air pump 84 is provided, which is arranged in tank venting line 82. A tank venting valve 86 is also provided in tank venting line 82 to control the discharge of the fuel vapor into intake line 31.

Internal combustion engine 10 is operatively connected to a control device 90, which includes a memory unit 92 and a computing unit 94. A computer program code 96 is stored in memory unit 92, which carries out a method according to the invention to diagnose a crankcase breather when computer program code 96 is executed by computing unit 94 of control device 90.

Figure 2:
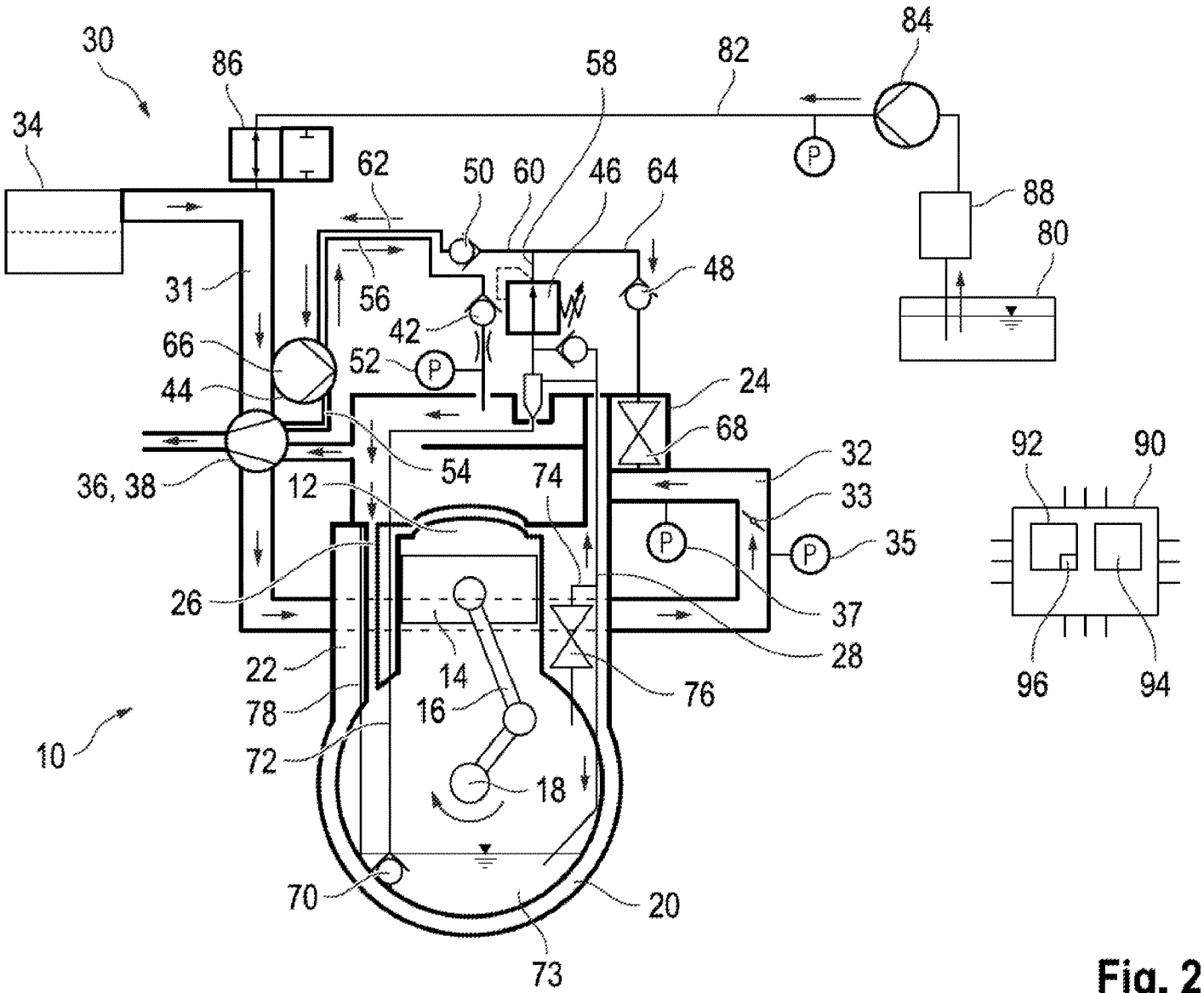
FIG. 2 shows an example of an internal combustion engine for carrying out a method according to the invention to diagnose a crankcase system of the internal combustion engine.

FIG. 2 shows an example of an internal combustion engine 10 for carrying out a method according to the invention to diagnose a crankcase system 20, 26, 28, 56, 58 of internal combustion engine 10. Internal combustion engine 10 includes an engine block 22 and a cylinder head 24. Internal combustion engine 10 furthermore includes at least one combustion chamber 12, which is limited by cylinder head 24, engine block 22, as well as a piston 14. Internal combustion engine 10 preferably includes multiple combustion chambers 12. Piston 14 is connected to a crankshaft 18 via a connecting rod 16, which converts an oscillating movement of piston 14 into a rotational movement. Crankshaft 18 is surrounded by a crankcase 20, which is connected to engine block 22 of internal combustion engine 10.

Internal combustion engine 10 is connected to an air supply system 30 on the inlet side, via which fresh air may be supplied to combustion chamber 12 of internal combustion engine 10. Air supply system 30 comprises an air filter 34 for filtering the sucked-in air. Air supply system 30 further comprises an intake line 31, which connects air filter 34 to a compressor 36 of an exhaust gas turbocharger 38. Compressor 36 of the exhaust gas turbocharger is connected to an inlet of internal combustion engine 10 via an intake manifold 32. A throttle valve 33 is arranged in intake manifold 32 for controlling the amount of air supplied to combustion chamber 12. A boost pressure sensor 35 for capturing the boost pressure of exhaust gas turbocharger 38 is arranged in intake manifold 32 downstream from compressor 36 of exhaust gas turbocharger 38 and upstream from throttle valve 33. An intake manifold pressure sensor 37 is arranged in the intake manifold downstream from the throttle valve and upstream from the inlet of internal combustion engine 10. The intake manifold pressure essentially corresponds to the boost pressure of exhaust gas turbocharger 38 when throttle valve 33 is opened all the way.

Internal combustion engine 10 is furthermore connected to an exhaust system via its outlet, a turbine 39 of exhaust gas turbocharger 38 being arranged in the exhaust system, through which an exhaust gas flow of internal combustion engine 10 flows and drives compressor 36 of exhaust gas turbocharger 38.

A ventilation channel 26 is formed in engine block 22, which establishes a fluid connection between a first region of cylinder head 24 and crankcase 20. A breather channel 28 is also formed in engine block 22, which fluidically connects crankcase 20 to a second region of cylinder head 24. An oil recirculation channel 70 is provided in crankcase 20, via which oil may flow back into an oil pan 73. A first oil separator 72 is furthermore arranged in crankcase 20, to prevent oil mist from entering ventilation channel 26. A second oil separator 74 is additionally arranged in crankcase 20, which prevents an entry of oil mist into breather channel 28. In addition, an oil recirculation channel 78 is formed in engine block 22 to permit a back-flow of oil into oil pan 73.

A first flow path is provided for breathing crankcase 20, via which fresh air compressed by compressor 36 of exhaust gas turbocharger 38 may be introduced into crankcase 20 via a purge line 54, a ventilation line 56 in cylinder head 24, and ventilation channel 26. A check valve 42 is arranged in ventilation line 56 to avoid an uncontrolled outflow of air from crankcase 20. A throttle 40 may also be arranged in ventilation line 56 to limit the amount of fresh air supplied to crankcase 20. A pressure sensor 52 is furthermore arranged in ventilation line 56, with the aid of which a pressure in ventilation line 56 may be captured. Due to the fluid connection between the ventilation line and crankcase 20, a function of the crankcase breather may be inferred from the pressure change of ventilation line 56.

To discharge the air from crankcase 20, a second flow path is provided, via which the air may be supplied from crankcase 20 to air supply system 30 via breather channel 28 and a breather line 58 in cylinder head 24 of internal combustion engine 10. A pressure control valve 46 is arranged in breather line 58. Breather line 58 has a branch 60 downstream from pressure control valve 46, at which breather line 58 is divided into a first section 62, which is connected to intake line 31 of the internal combustion engine via a suction jet pump 44, and into a second section 64, which is connected to intake manifold 32 of air supply system 30. A check valve 50 is arranged in first section 62, which prevents an inflow of fresh air from intake line 31 into breather line 58. First section 62 empties into intake line 31 of air supply system 30 at an opening 66, which is situated downstream from air filter 34 and upstream from compressor 36 of exhaust gas turbocharger 38. A check valve 48 is furthermore arranged in second section 64, which prevents an inflow of fresh air from intake manifold 32 into breather line 58. Second section 64 opens into intake manifold 32 of air supply system 30 at a second opening 68 downstream from throttle valve 33.

Internal combustion engine 10 is furthermore operatively connected to a fuel supply system. To avoid an uncontrolled escape of fuel vapors from fuel tank 80, an active carbon filter 88 is provided, in which these fuel vapors are trapped and bound. Active carbon filter 88 is connected to intake line 31 of air supply system 30 via a tank venting line 82. To regenerate active carbon filter 88, a purge air pump 84 is provided, which is arranged in tank venting line 82. A tank venting valve 86 is also provided in tank venting line 82 to control the discharge of the fuel vapor into intake line 31.

Internal combustion engine 10 is operatively connected to a control device 90, which includes a memory unit 92 and a computing unit 94. A computer program code 96 is stored in memory unit 92, which carries out a method according to the invention to diagnose a crankcase breather when computer program code 96 is executed by computing unit 94 of control device 90.

Figure 3:
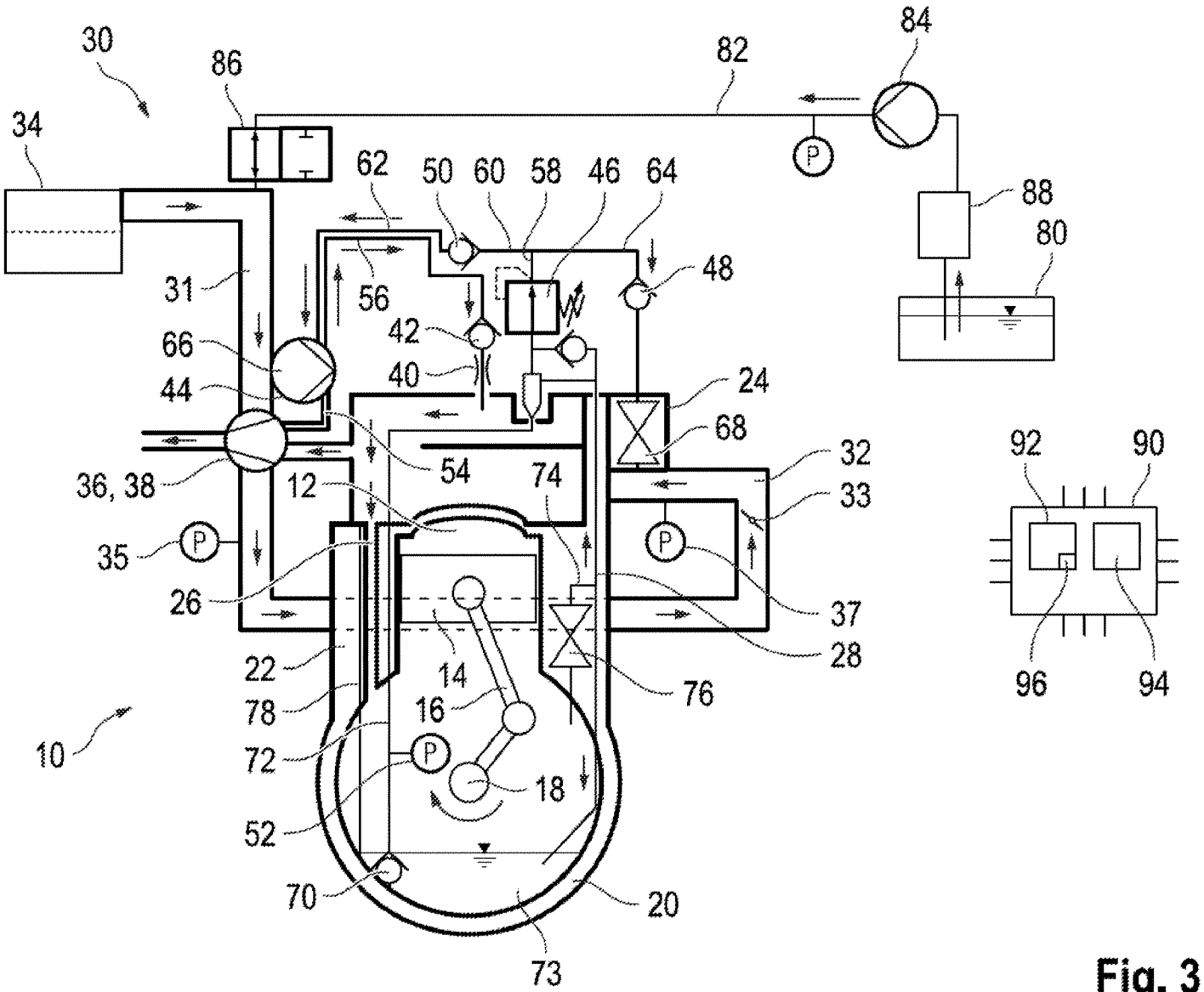
FIG. 3 shows an example of an internal combustion engine for carrying out a method according to the invention to diagnose a crankcase system of the internal combustion engine.

FIG. 3 shows an example an internal combustion engine 10 for carrying out a method according to the invention to diagnose a crankcase system 20, 26, 28, 56, 58 of internal combustion engine 10. Internal combustion engine 10 includes an engine block 22 and a cylinder head 24. Internal combustion engine 10 furthermore includes at least one combustion chamber 12, which is limited by cylinder head 24, engine block 22, and a piston 14. Internal combustion engine 10 preferably includes multiple combustion chambers 12. Piston 14 is connected to a crankshaft 18 via a connecting rod 16, which converts an oscillating movement of piston 14 into a rotational movement. Crankshaft 18 is surrounded by a crankcase 20, which is connected to engine block 22 of internal combustion engine 10.

Internal combustion engine 10 is connected to an air supply system 30 on the inlet side, via which fresh air may be supplied to combustion chamber 12 of internal combustion engine 10. Air supply system 30 comprises an air filter 34 for filtering the sucked-in air. Air supply system 30 further comprises an intake line 31, which connects air filter 34 to a compressor 36 of an exhaust gas turbocharger 38. Compressor 36 of the exhaust gas turbocharger is connected to an inlet of internal combustion engine 10 via an intake manifold 32. A throttle valve 33 is arranged in intake manifold 32 for controlling the amount of air supplied to combustion chamber 12. A boost pressure sensor 35 for capturing the boost pressure of exhaust gas turbocharger 38 is arranged in intake manifold 32 downstream from compressor 36 of exhaust gas turbocharger 38 and upstream from throttle valve 33. An intake manifold pressure sensor 37 is arranged in the intake manifold downstream from the throttle valve and upstream from the inlet of internal combustion engine 10. The intake manifold pressure essentially corresponds to the boost pressure of exhaust gas turbocharger 38 when throttle valve 33 is opened all the way.

Internal combustion engine 10 is furthermore connected to an exhaust system via its outlet, a turbine 39 of exhaust gas turbocharger 38 being arranged in the exhaust system, through which an exhaust gas flow of internal combustion engine 10 flows and drives compressor 36 of exhaust gas turbocharger 38.

A ventilation channel 26 is formed in engine block 22, which establishes a fluid connection between a first region of cylinder head 24 and crankcase 20. A breather channel 28 is also formed in engine block 22, which fluidically connects crankcase 20 to a second region of cylinder head 24. An oil recirculation channel 70 is provided in crankcase 20, via which oil may flow back into an oil pan 73. A first oil separator 72 is furthermore arranged in crankcase 20, to prevent an entry of oil mist into ventilation channel 26. A second oil separator 74 is additionally arranged in crankcase 20, which prevents an entry of oil mist into breather channel 28. In addition, an oil recirculation channel 78 is formed in engine block 22 to permit a back-flow of oil into oil pan 73.

A first flow path is provided for breathing crankcase 20, via which fresh air compressed by compressor 36 of exhaust gas turbocharger 38 may be introduced into crankcase 20 via a purge line 54, a ventilation line 56 in cylinder head 24, and ventilation channel 26. A check valve 42 is arranged in ventilation line 56 to avoid an uncontrolled outflow of air from crankcase 20. A throttle 40 may also be arranged in ventilation line 56 to limit the amount of fresh air supplied to crankcase 20.

To discharge the air from crankcase 20, a second flow path is provided, via which the air may be supplied from crankcase 20 to air supply system 30 via breather channel 28 and a breather line 58 in cylinder head 24 of internal combustion engine 10. A pressure control valve 46 is arranged in breather line 58. Breather line 58 has a branch 60 downstream from pressure control valve 46, at which breather line 58 is divided into a first section 62, which is connected to intake line 31 of the internal combustion engine via a suction jet pump 44, and into a second section 64, which is connected to intake manifold 32 of air supply system 30. A check valve 50 is arranged in first section 62, which prevents an inflow of fresh air from intake line 31 into breather line 58. First section 62 opens into intake line 31 of air supply system 30 at a first opening 66, which is situated downstream from air filter 34 and upstream from compressor 36 of exhaust gas turbocharger 38. A check valve 48 is furthermore arranged in second section 64, which prevents an inflow of fresh air from intake manifold 32 into breather line 58. Second section 64 empties into intake manifold 32 of air supply system 30 at a second opening 68 downstream from throttle valve 33. A pressure sensor 52, which detects a pressure in crankcase 20, is arranged in crankcase 20. A function of the crankcase breather may be inferred from a change of the pressure in air supply system 30 and a change of the pressure in crankcase 20 resulting therefrom.

Internal combustion engine 10 is furthermore operatively connected to a fuel supply system. To avoid an uncontrolled escape of fuel vapors from fuel tank 80, an active carbon filter 88 is provided, in which these fuel vapors are trapped and bound. Active carbon filter 88 is connected to intake line 31 of air supply system 30 via a tank venting line 82. To regenerate active carbon filter 88, a purge air pump 84 is provided, which is arranged in tank venting line 82. A tank venting valve 86 is also provided in tank venting line 82 to control the discharge of the fuel vapor into intake line 31.

Internal combustion engine 10 is operatively connected to a control device 90, which includes a memory unit 92 and a computing unit 94. A computer program code 96 is stored in memory unit 92, which carries out a method according to the invention to diagnose a crankcase breather when computer program code 96 is executed by computing unit 94 of control device 90.

Figure 4:
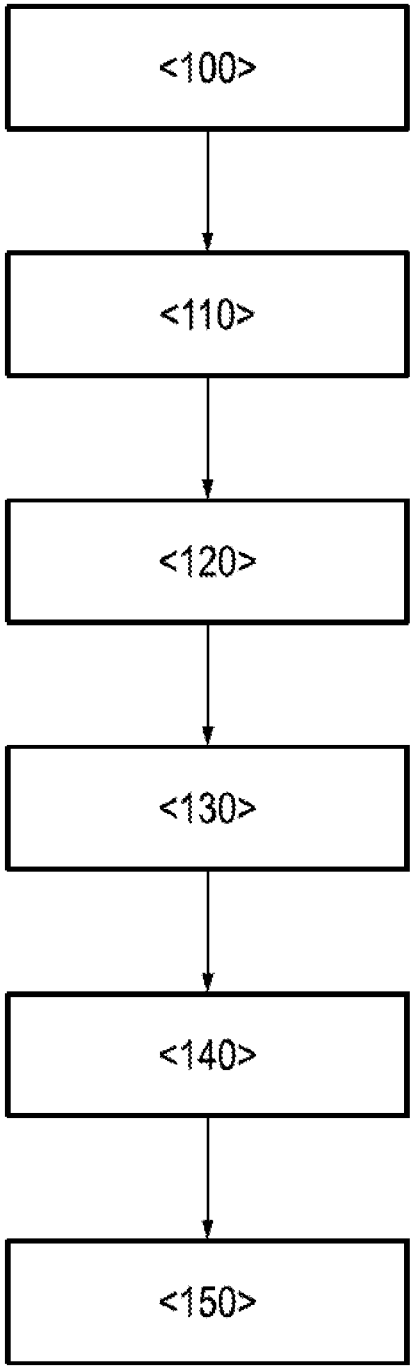
FIG. 4 shows a flowchart for carrying out a method according to the invention to diagnose a crankcase system of an internal combustion engine.

FIG. 4 shows a flowchart for carrying out a method according to the invention to diagnose a crankcase breather of an internal combustion engine 10. In a first method step <100>, a temporal change of pressure $\Delta p_{KS}$ in crankcase 20 or in a component 22, 24, 26, 28 fluidically connected to crankcase 20 is captured. In a method step <110>, a pressure change $\Delta p_{REF}$ of a reference pressure is also captured, or a temporal change $\Delta p_{KSM}$ to be expected for a pressure change in crankcase 20 is modeled. In a method step <120>, a gradient is formed from temporal pressure change $\Delta p_{KS}$ of the pressure in the crankcase and pressure change $\Delta p_{REF}$ of the reference pressure or pressure change $\Delta p_{KSM}$ to be expected in crankcase 20. This gradient is integrated over time in a method step <130>. In a method step <140>, the value obtained by the integration is compared with a threshold value, a malfunction or a defect of the crankcase breather is inferred in a method step <150> upon an exceeding of the threshold value.

Figure 5:
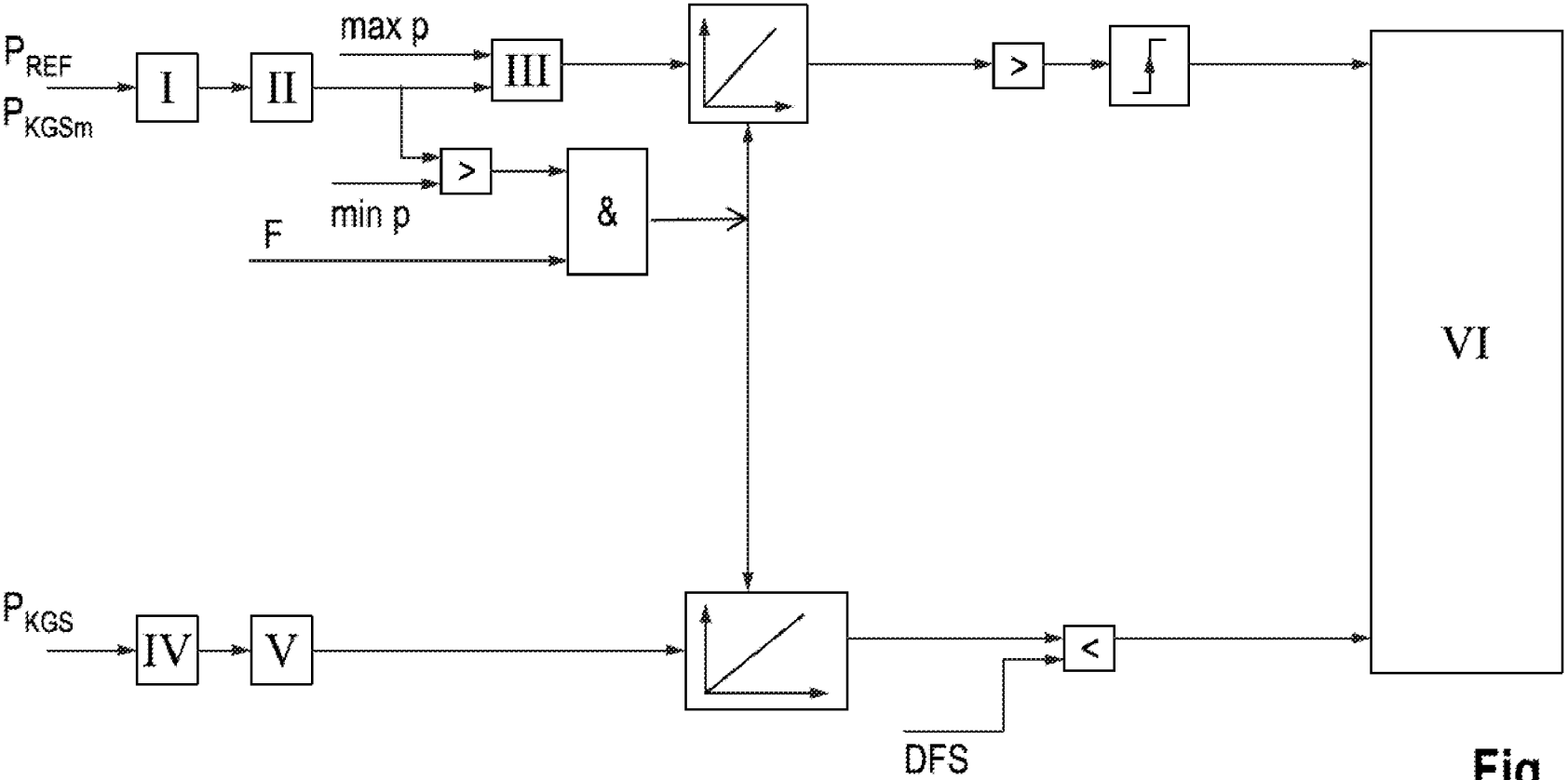
FIG. 5 shows a further flowchart for carrying out a method according to the invention for the purpose of diagnosing a crankcase system.

FIG. 5 shows a further flowchart of a method according to the invention to diagnose a crankcase system 10, 26, 28, 56, 58. A reference pressure $p_{REF}$ or a modeled pressure in the crankcase system $p_{KGSm}$ and a measured pressure in the crankcase system $p_{KGS}$ are provided as input variables. A first filter I, in particular a PTx filter, is provided for reference pressure $p_{REF}$ or a modeled pressure in the crankcase system $p_{KGSm}$ for the purpose of smoothing the measured values captured by the sensor for the reference pressure. A differentiation element II is subsequently provided, with the aid of which a gradient of reference pressure $p_{REF}$ or of modeled pressure $p_{KGSm}$ in the crankcase system is formed. If the value of reference pressure $p_{REF}$ or of modeled pressure $p_{KGSm}$ in the crankcase system is between a permissible minimum pressure $p_{min}$ and a permissible maximum pressure $p_{max}$, and if an enabling condition for the method is met, an integral of the gradient is formed.

A second filter IV, in particular a PTx filter, is provided in parallel for the measured pressure in crankcase system $p_{KGS}$ for the purpose of smoothing the measured values captured by the sensor for the reference pressure. A differentiation element V is subsequently provided, with the aid of which a gradient of pressure $p_{KGS}$ in the crankcase system is formed. If the enabling condition is met, an integral of the gradient is formed. The integral is compared with a defect threshold DFS. If the integral is above the defect threshold, an intact function of the crankcase system may be assumed during evaluation VI.

If the integral is below a threshold value, a defect of the crankcase system may be inferred in evaluation VI, since the gradient to be diagnosed is smaller than a gradient to be expected for a function of the crankcase system.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for diagnosing a crankcase system of an internal combustion engine, the method comprising:

capturing a pressure value in a crankcase system;

ascertaining a pressure value of a reference pressure or modeling a pressure value to be expected in the crankcase system;

forming a gradient of the pressure value in the crankcase system and a gradient of the reference pressure or the modeled pressure in the crankcase system;

integrating the two formed gradients over time; and evaluating the function of the crankcase system based on the values obtained by the integrations.

2. The method according to claim 1, wherein the internal combustion engine is an internal combustion engine supercharged with the aid of an exhaust gas turbocharger, the reference pressure being captured in an intake manifold of an air supply system of the internal combustion engine, the intake manifold connecting a compressor of the exhaust gas turbocharger to an inlet of the internal combustion engine.

3. The method according to claim 2, wherein the reference pressure in the intake manifold is captured downstream from a throttle valve.

4. The method according to claim 2, wherein the reference pressure in the intake manifold is captured downstream from the compressor and upstream from a throttle valve.

5. The method according to claim 1, wherein a driving air flow is provided by an exhaust gas turbocharger, and a Venturi nozzle is arranged or formed in a breather line of the crankcase with the aid of which an underpressure is generated or amplified in the crankcase system.

6. The method according to claim 1, wherein an initiation of the method takes place when a boost pressure of the exhaust gas turbocharger and/or an intake manifold pressure has exceeded a defined threshold value, and/or wherein an underpressure is present at a Venturi nozzle in a breather line of the crankcase system.

7. The method according to claim 1, wherein a change of the pressure in the crankcase system is evaluated as a response to a change of the boost pressure during a pressure buildup or pressure reduction of the boost pressure.

8. The method according to claim 7, wherein an evaluation range lasts from a start of the change of the boost pressure to a point in time, at which no further rise or fall of the boost pressure takes place.

9. The method according to claim 1, wherein the pressure in the crankcase system is captured in a breather line or in a ventilation line of the crankcase or in the crankcase.

10. The method according to claim 1, wherein an initiation of the method takes place when the integral of the reference pressure gradient or the integral of the modeled pressure gradient in the crankcase system exceeds a defined threshold value.

11. The method according to claim 1, wherein the results of the integrations are each compared with a threshold value, and upon exceeding a first threshold value or upon dropping below a second threshold value for the integral of the pressure gradient in the crankcase system, a defect of the crankcase system is determined.

12. The method according to claim 1, wherein a relation of the two integrals or a difference from the two integrals is formed, and a function of the crankcase breather is determined based on the relation or the difference.

13. The method according to claim 1, wherein the pressure signal of the reference pressure or of the modeled pressure in the crankcase system and the pressure signal of the measured pressure in the crankcase system are filtered.

14. A control device comprising a memory unit and a computing unit, wherein a computer program product is stored in the memory unit, which, when executed by the computing unit, carries out the method according to claim 1.

15. An internal combustion engine comprising:

at least one combustion chamber, wherein the combustion chamber is limited by a piston, which is connected to a crankshaft via a connecting rod, the crankshaft being arranged in a crankcase; and the control device according to claim 14.

* * * * *